United States Patent [19]

Callinan et al.

[11] Patent Number: 4,966,609

[45] Date of Patent: Oct. 30, 1990

[54] CONFORMABLE ABRASIVE ARTICLE

[75] Inventors: Kevin M. Callinan, Michigan City; James P. Enniss, Granger, both of Ind.

[73] Assignee: Uniroyal Plastics Co., Inc., Mishawaka, Ind.

[21] Appl. No.: 335,004

[22] Filed: Apr. 7, 1989

[51] Int. Cl.[5] ..... B24D 11/00

[52] U.S. Cl. ..... 51/295; 51/296; 51/293

[58] Field of Search ..... 51/295, 296, 298

[56] References Cited

U.S. PATENT DOCUMENTS

| | | | |
|---|---|---|---|
| 2,446,183 | 8/1948 | Larson | 51/187 |
| 2,650,158 | 8/1953 | Eastman | 51/298 |
| 2,780,533 | 2/1957 | Hurst | 51/297 |
| 2,804,729 | 9/1957 | Dahlstrom | 51/187 |
| 3,021,649 | 2/1962 | Robbins | 51/185 |
| 3,075,222 | 1/1963 | Miller | 15/209 |
| 3,094,735 | 6/1963 | Hanlan | 15/506 |
| 3,229,425 | 1/1966 | Homeyer | 51/211 |
| 3,230,672 | 1/1966 | Anthon | 51/404 |
| 3,284,963 | 11/1966 | Lanham et al. | 51/400 |
| 3,401,490 | 9/1968 | Mora | 51/295 |
| 3,428,405 | 2/1969 | Posner | 401/201 |
| 3,653,859 | 4/1972 | Zimmer, Jr. et al. | 51/401 |
| 3,701,703 | 10/1972 | Zimmer, Jr. et al. | 156/278 |
| 3,777,444 | 12/1973 | Dunn | 51/391 |
| 4,038,047 | 7/1977 | Haywood | 51/295 |
| 4,111,666 | 9/1978 | Kalbow | 51/295 |
| 4,202,139 | 5/1980 | Hong et al. | 51/393 |
| 4,240,807 | 12/1980 | Kronzer | 51/295 |
| 4,255,164 | 3/1981 | Butzke et al. | 51/295 |
| 4,355,489 | 10/1982 | Heyer et al. | 51/400 |
| 4,459,987 | 7/1984 | Pangburn | 128/355 |
| 4,510,641 | 4/1985 | Morris | 15/115 |
| 4,576,612 | 3/1986 | Shukla et al. | 51/295 |
| 4,581,287 | 4/1986 | Smith et al. | 428/290 |
| 4,606,154 | 8/1986 | Herrmann et al. | 51/401 |
| 4,629,473 | 12/1986 | Ruid et al. | 51/295 |
| 4,665,580 | 5/1987 | Morris | 15/118 |
| 4,714,644 | 12/1987 | Rich | 428/136 |

FOREIGN PATENT DOCUMENTS

| | | |
|---|---|---|
| 0004454 | 3/1979 | European Pat. Off. . |
| 145013 | 3/1935 | Fed. Rep. of Germany . |
| 1597455 | 9/1981 | United Kingdom . |
| 2113241 | 8/1983 | United Kingdom . |
| 2114925 | 9/1983 | United Kingdom . |

*Primary Examiner*—William R. Dixon, Jr.
*Assistant Examiner*—Willie Thompson
*Attorney, Agent, or Firm*—Pennie & Edmonds

[57] ABSTRACT

A flexible abrasive article for cleaning, polishing or smoothing objects which is resistant to absorption of liquid and capable of conforming to the shape of the object. The article comprises a flexible resilient closed cell polyvinyl chloride foam substrate having upper and lower surfaces with a reinforcing textile layer and abrasive particulate matter adhered to at least one surface. The reinforcing textile layer may be buried within the foam substrate with abrasive particulate adhered to one or both surfaces of the substrate. Or the textilforcing textile layer and abrasive particulate matter adhered to at least one surface. The reinforcing textile layer may be buried within the foam substrate with abrasive particulate adhered to one or both surfaces of the substrate. Or the textile layer may be adhered to one surface and the particulate matter adhered to the other. In addition, the article may be laminated to a thermoformable rigid sheet to produce shaped tools.

24 Claims, No Drawings

CONFORMABLE ABRASIVE ARTICLE

TECHNICAL FIELD

The invention relates to flexible, conformable articles for cleaning, polishing and smoothing surfaces of various objects and more specifically to an abrasive article which is conformable or can easily be conformed to the surface of such objects.

BACKGROUND ART

Many articles are available for cleaning surfaces of an object by abrasive action of an article rubbed by machine or hand on a surface. Surfaces may be two dimensional, flat or curved, or three dimensional shapes with complex combinations of curved and flat surfaces. Most conventional articles which provide the necessary cleaning, polishing and grinding action on such surfaces are stiff or rigid and fail to conform to complex curved surfaces.

Various flexible pads have been developed whereby abrasive grains have been adhesively secured to open cell foam substrates which are capable of absorbing fluids. For example, U.S. Pat. Nos. 2,780,533 and 2,650,158 each describe an abrasive pad comprising a porous or sponge rubber layer which includes a layer of abrasive grains adhered to one surface of the sponge layer.

Methods of making such open celled abrasive foam products are also disclosed in numerous prior art patents, with U.S. Pat. No. 3,701,703 being a typical example of such patents. U.S. Pat. No. 3,653,859 also disclose a low density open celled foam which is impregnated with a slurry formed of an adhesive and abrasive grain. A method of forming an abrasive article by heating an open celled meltable base and distributing abrasive particles over the surface is disclosed in U.S. Pat. No. 3,401,490.

U.S. Pat. No. 2,804,729 discloses the use of closed-cell foam rubber to form a sanding block. However, this configuration involves adhering two foam layers together along one edge only so that the layers may be pulled open to insert a portion of a folded abrasive sheet. A stiffening element, such as a metal plate, is placed between these layers providing increased rigidity.

It is also known in the prior art to secure rigid or flexible backings to open celled foams having a layer of abrasive particles. For example, U.S. Pat. No. 4,714,644 relates to a sanding pad having abrasive granules adhered to a stiff rectangular layer of cloth which is in turn adhered to a layer of open cell polyurethane foam. Similarly, U.S. Pat. No. 4,629,473 discloses an open cell foam which is laminated to a finished cloth backing. An adhesive coat is applied to the foam layer, then an electrostatic coating of abrasive grain is applied to the wet adhesive.

U.S. Pat. No. 4,606,154 relates to a coated abrasive material for use on abrasive belts. This material comprises a textile backing having an elastic intermediate layer, and an adhesive base binder with abrasive particles. The intermediate layer is a thin layer containing at least one elastic polymer, such as polyurethane, which has limited compressibility.

None of these prior art abrasive articles, however, disclose the use of a closed cell flexible polyvinyl chloride (PVC) foam having an abrasive coating on one or both sides so as to provide a flexible and durable abrasive material capable of conforming to even the most complex surfaces. Furthermore, this abrasive material will not absorb liquids usually associated with the cleaning, polishing and grinding operations.

SUMMARY OF THE INVENTION

The present invention relates to a flexible abrasive article for cleaning, polishing or smoothing objects which is conformable to the shape of the object comprising a flexible, liquid resistant closed cell thermoplastic polyvinyl chloride foam substrate having particulate matter adhered to at least one of its faces.

The closed cell substrate may be any foam which is resistant to the absorption of liquids and is conformable to a wide range of shapes without creasing, tearing, cracking or fracturing. High tensile strength for increased durability is also a desirable characteristic of this foam. Some examples of usable foams are polyolefin and polyurethane, but preferably it is a polyvinyl chloride foam.

The particulate matter or grit may be any natural or synthetic granular particles of the usual type used for grinding, polishing, cleaning or smoothing surfaces. Garnet, emery, aluminum oxide, silicon carbide, zirconium oxide are some examples of available grit. The size and type of the grit chosen depends on a variety of factors such as the type of finish required and the material of the object. Also, two different sizes of grit may be applied to opposite faces of the foam substrate to create a multi-purpose article which may be capable of both cleaning and smoothing, for example, the surface of an object.

Such grit may be adhered to the foam substrate via a soft flexible adhesive which does not adversely affect the conformability of the article, such as a layer of pressure sensitive or non-pressure sensitive adhesive. The pressure sensitive adhesive may be coated onto the substrate and dried prior to the introduction of the grit. The grit may also be adhered to a pressure sensitive or non-pressure sensitive adhesive coating before such coats are dried and cured upon the surface of the foam. Another possible method is to apply a coat of non-pressure sensitive adhesive which is dried and cured. Subsequently, the adhesive would be activated by heat and the grit introduced.

Alternatively, the grit may be introduced into an adhesive binder of natural or synthetic rubber, polyurethane, polyester, acrylate or olefinic resin prior to coating the substrate. This mixture could then be applied to the surface of the substrate by coating or spraying.

An alternate embodiment of the invention relates to a flexible abrasive article having a textile reinforcement to provide increased strength and to restrict extensibility. The reinforcement may be any knit, woven or non-woven fabric which may easily be adhered to the foam substrate and is preferably a textile fabric. This backing may be buried inside the foam substrate or adhered to the surface of the foam opposite the grit. In this embodiment, the article may be a flat sheet or a belt for use in belt sanding.

A further embodiment of the invention relates to a flexible abrasive article having a rigid support laminated to the face of the foam substrate opposite to the particulate matter. The rigid sheet may be an acrylonitrile butadiene styrene (ABS) copolymer sheet, polyethylene terephthalate (PET) or other polyester sheet material. Polyolefin sheet such as polyethylene, polypropylene may also be used, including crosslinked types plus any other thermoplastic sheet which may yield, stretch or form upon heating the sheet to its elastic liquid state. After heating, the sheet is compressed or vacuum formed to a desired shape which becomes fixed upon cooling. In this embodiment, the foam substrate and the rigid sheet are thermoformed to conform to the shape of the surface to be cleaned or polished.

DETAILED DESCRIPTION OF THE INVENTION

The article of the invention contains qualities useful for cleaning, polishing and smoothing complex curved as well as flat plane surfaces It is flexible, extensible and conformable thus enabling even pressure contact over a region of a complex curved surface. It may also be formed to a relatively fixed shape to match the shape of a surface to be cleaned or polished.

The base material for the article of the invention is a closed cell flexible polyvinyl chloride (PVC) foam. It may be typically 5 to 250 mils thick, have a density from 15 to 50 pounds per cubic feet. Other foams such as polyolefin, and polyurethane, and foams are available, but these have limited used and performance in the invention. Polyolefin foams provide adequate performance, but PVC has been found to be the material of choice due to its combination of relatively low cost and desirable physical properties. The chemical composition of the preferred PVC foam is shown in Table 1.

TABLE 1

| Chemical Composition of PVC Foam | Parts by Weight |
|---|---|
| pVC dispersion resin | 100 |
| Plasticizer | 50–100 |
| Stablizer | .5–2 |
| Chemical blowing agent | .5–2.5 |
| $CaCO_3$ | 0–30 |
| Color Pigment | 0–10 |

PVC has high tensile and tear properties for durability and can be formed as a closed cell foam which resists absorption of liquids occasionally used during cleaning, polishing and grinding of surfaces. The soft flexible PVC foam acts as a cushion over rough surfaces which are irregular and can easily conform thereto to maintain uniform contact of the article with the surface. The resiliency of the PVC foam cushion can be varied from Indenter Load Deflection (ILD) values of between 15–195. The toughness and flexibility of this PVC foam enables it to be bent, creased, or stretched without cracking or tearing, and these properties aid in its conformability to irregular surfaces.

Closed cell PVC foam has the unique characteristic of slow resiliency which makes it particularly suited for use as described in this invention. High resiliency refers to foams which rebound to original dimension almost immediately after compression forces are released. The rebound forces in the foam are elastic and are always present to restore the foam to original shape. Low resiliency foam rebounds very little after compression forces are released. Rebound forces in foams having low resiliency are small or absent so that when compression forces are removed, the foam retains the shape of the compressed state. High and low resiliency is less desirable than slow resiliency. Slow resilient PVC foam has delayed rebound forces in the foam. When compression forces are released, restoration to the original foam shape takes time.

Slow restoration is more desirable in sanding rough surfaces. The slow resilient PVC foam conforms to ridges on a rough surface, for instance, and retains the conformed shape periodically without rebound forces trying to restore the foam to its original shape. The absence of immediate rebound forces permits a more even pressure over the surface of the object being polished which is desirable.

The surface of the foam, on either one or both sides, contains an abrasive grit layer to provide the necessary cleaning, polishing or grinding action upon the object surface. Such grit may be adhered to the foam by a pressure sensitive adhesive which is initially coated and dried upon the foam surface prior to introducing the grit thereon. The grit could also be adhered to a pressure sensitive or non-pressure sensitive adhesive coating by applying the grit to the adhesive before the combination is dried or cured upon the foam. The grit could also be applied to a dry non-pressure sensitive adhesive and adhered to the adhesive by heating or activating the adhesive. In these methods of application, the abrasive grit is not impregnated into the foam, but is located upon the surface of the adhesive which is adhered to the foam surface.

Some examples of preferred pressure sensitive adhesives are listed in Table 2.

TABLE 2

| Pressure Sensitive Adhesives | |
|---|---|
| Rohm & Haas | N1031 |
| Air products | Flexbond 153 |
| Uniroyal Adhesives & Sealants | DC 11298 |

The PVC foam formula must be modified for use under pressure sensitive adhesives. Migrating plasticizers frequently attack the pressure sensitive adhesive and make it unacceptable. Inclusion of low migrating plasticizers such as polymeric polyesters (Emery 9762A) at 40 pph, low migrating or less adhesive compatible monomeric plasticizers such as dioctyl terephthalate improves the life and (DOTP) maintains performance of preferred pressure sensitive adhesives.

An alternate method of attaching the grit to the foam is to incorporate the grit into an adhesive binder of a natural or synthetic rubber, polyurethane, polyester, acrylate, or olefinic resin such as Permuthane UE 40-357 and Rohm & Haas E 1242. A polyacrylic thickener, such as Rohm & Haas ASE-60, is added to the resin to facilitate application of the adhesive. The resins must remain soft so as to retain the flexing, bending and conformability character of the article and preferably exhibits an elongation between about 100 to about 600% and a 100% modulus of between about 1500 to about 6000 psi. This method increases the life of the article by extending the working life of the article before the abrasive layer becomes worn off and ineffective. The preferred formula for the impregnated grit binder used in this embodiment is shown in Table 3.

TABLE 3

| Impregnated grit binder formula | Parts by Weight |
|---|---|
| Water | 20–60 |
| Abrasive grit | 40–100 |
| Rohm & Haas ASE-60 | 3–6 |
| Permuthane UE 40-357 | 50 |

A textile fabric, knit, woven or nonwoven, may be incorporated inside the PVC foam or adhered to an outer, non-grit containing surface of the PVC foam. The fabric alters the strength and extensibility of the article of the invention and provides increased strength and limits extensibility for applications where high stresses are applied to the article. This renders the article useful for belt sanding where the article acts as an unsupported belt.

The physical form of the article of invention may be a flat sheet, a belt formed by a butt or lap seaming the ends, or any shape formed by a thermoforming process. The thermoformed shape could mirror image the surface to be cleaned, polished or smoothed to enable intimate contact of a complex extruded profile, a segment of a spherical shape or other surface profile. The nature of closed cell PVC foam renders it ideally suitable for thermoforming. The lamination of a rigid sheet on the foam side opposite the grit coating, such as an ABS sheet 5–50 mil thick for example, would make a useful base for the thermoformed article for cleaning, polishing and grinding operations. Once thermoformed, the tool would hold the formed shape yet the abrasion surface opposite the rigid sheet would be supported by the soft foam cushion so that it can conform to any irregularities in the object surface.

As an alternate to this embodiment, the backing sheet could be thermoformed into a shape that fits comfortably into the hand of the user. This design would reduce muscle fatigue in the user's hand allowing him to work more efficiently. Or, the thermoformed shape could provide means to attach the tool to a periphery device, such as a sanding or polishing machine.

Grit size and material may be of any of the usual types for grinding, polishing or cleaning of surfaces. Such grits are generally hard granular particles of the kind commonly used on abrasive articles, such as emery cloth. Among the types of grits available are garnet, emery, aluminum oxide, silicon carbide, zirconium oxide and the like. Any of these, or mixtures thereof, can be useful in this invention. One skilled in the art can best select the type of grit for the particular cleaning operation.

The soft flexible nature of the PVC foam and softness of the adhesive make the article of the invention work in a much superior manner to conventional stiff abrasive products. The backing yields to forces acted upon it during rubbing, so that the hard abrasive particles on the foam surface do not gouge or scratch the surface of the object. Thus, the abrasive particles remove only surface matter when rubbed on the object surface. For example, 400 grit silicone carbide sandpaper will scratch and dull the bright paint sheen on a car. The article of the invention, with the same 400 grit rubbed similarly on the car paint, will not scratch the surface, but will remove dirt, scratches and marks therefrom.

Several but not all uses of the article of invention are described are the cleaning, polishing and grinding of metals including chrome, gold, brass, silver and plates, glass, ceramics, and wood plastics. The invention is also useful in cleaning, polishing and grinding decorative color coats on metal, plastics, organic polymer, glass, ceramics, wood and paper products. Similarly, the invention is useful for hygienic and medical purposes for cleaning, polishing and grinding biomaterials such as teeth, fingernails and finger nail polish and skin. The invention is especially useful for cleaning and polishing interior surfaces of cylindrical or other geometric bodies. For example textile supported or unsupported disc sheet which is center mounted on the end of a rotating shaft will conform to the interior surfaces while the shaft spins.

These and other special uses are possible because of the flexible and conformable character of the article of the invention.

While it is apparent that the invention herein disclosed is well calculated to fulfill the objects above stated, it will be appreciated that numerous embodiments and modifications may be devised by those skilled in the art, and it is intended that the appended claims cover all such modifications and embodiments as fall within the true spirit and scope of the present invention.

What is claimed:

1. A flexible abrasive article for cleaning, polishing or smoothing of surfaces comprising a flexible, liquid resistant closed cell thermoplastic polyvinylchloride polyolefin or polyurethane foam substrate which is resistant to absorption or liquids and is capable of conforming to the shape of the irregular surface of an object, said substrate having abrasive particulate matter adhered to at least one surface thereof.

2. The article of claim 1 wherein said foam substrate further comprises at least one layer of a soft flexible adhesive for adhering said abrasive particulate matter thereto without detrimentally affecting the flexibility and conformability of the substrate.

3. The article of claim 2 wherein said adhesive is a pressure sensitive adhesive.

4. The article of claim 3 wherein said abrasive particulate matter is adhered to said pressure sensitive adhesive prior to the drying and curing of said adhesive.

5. The article material of claim 3 wherein said abrasive particulate matter is adhered to said pressure sensitive adhesive after the drying and curing of said adhesive.

6. The article of claim 1 wherein said abrasive particulate matter is adhered to more than one surface of said substrate.

7. The article of claim 1 wherein said abrasive particulate matter is incorporated into an adhesive binder which is subsequently coated onto said foam substrate.

8. The article of claim 1 further comprising a reinforcement layer adhered to said substrate on a surface opposite that of said abrasive particulate matter.

9. The article of claim 8 wherein said reinforcement layer is a textile fabric or a rigid thermoplastic sheet.

10. The article of claim 8 wherein said foam substrate is a sheet having upper and lower surfaces and having said abrasive particulate matter adhered to said upper surface and said reinforcement layer adhered to said lower surface.

11. The article of claim 10 wherein said sheet comprises a continuous belt.

12. The article of claim 1 further comprising a reinforcing textile layer within said foam substrate with particulate matter on surface of said foam substrate.

13. The article of claim 1 which further comprises a rigid support for said foam substrate and attached to a surface opposite that which contains said particulate matter.

14. The article of claim 13 wherein said substrate and said support are thermoformed to conform to the shape of the surface to be cleaned.

15. A flexible abrasive article for cleaning, polishing and smoothing surfaces comprising a flexible, resilient closed cell polyvinyl chloride foam substrate which is resistant to absorption of liquids and capable of conforming to the shape of an irregular surface of an object, said substrate being in the form of a sheet having upper and lower surfaces; abrasive particulate matter adhered to at least one surface of said substrate; and a textile layer for reinforcement of said article.

16. The abrasive article of claim 15 wherein said textile layer and said abrasive particulate matter are adhered to opposite surfaces of said foam.

17. The abrasive article of claim 15 wherein said textile layer is within said foam substrate and said particulate matter is included on both surfaces of said foam.

18. The article of claim 16 wherein said abrasive article comprises a continuous belt.

19. The article of claim 15 wherein said substrate further comprises at least one layer of a soft flexible pressure sensitive adhesive for adhering said abrasive particulate matter to said foam substrate.

20. The particle of claim 15 wherein said abrasive particulate matter is incorporated into an adhesive binder which is subsequently coated onto one surface of said foam substrate.

21. An abrasive article for cleaning, polishing and smoothing surfaces comprising a flexible, resilient closed cell polyvinyl chloride foam substrate which is resistant to absorption of liquids and capable of conforming to the shape of an irregular surface of an object, said substrate having upper and lower surfaces; a rigid sheet backing layer adhered to one of said surfaces of said substrate; and abrasive particulate matter adhered to the other surface; wherein said foam and said backing layer are thermoformed.

22. The abrasive article of claim 21 wherein said thermoformed shape mirrors the contour of the surface to be cleaned polished, ground or smoothed.

23. The abrasive article of claim 21 further comprising means for attachment to a peripheral device.

24. The abrasive article of claim 23 wherein said peripheral device is a polishing, grinding or smoothing machine.

* * * * *